US008408122B2

(12) United States Patent
Piscitello et al.

(10) Patent No.: US 8,408,122 B2
(45) Date of Patent: Apr. 2, 2013

(54) AUTO ALIGNING PAD PRINTER

(75) Inventors: Marc C. Piscitello, Plainfield, IL (US); Christopher T. Schaafsma, Wheaton, IL (US); Gerald L. Voegele, Verona, WI (US); Jesse C. Darley, Madison, WI (US)

(73) Assignee: Illinois Tool Works Inc., Glenview, IL (US)

( * ) Notice: Subject to any disclaimer, the term of this patent is extended or adjusted under 35 U.S.C. 154(b) by 504 days.

(21) Appl. No.: 12/396,928

(22) Filed: Mar. 3, 2009

(65) Prior Publication Data

US 2009/0277347 A1 Nov. 12, 2009

Related U.S. Application Data

(60) Provisional application No. 61/051,155, filed on May 7, 2008.

(51) Int. Cl.
*B41F 17/00* (2006.01)

(52) U.S. Cl. ..... 101/41; 101/42; 101/368

(58) Field of Classification Search ..... 101/41–44, 101/169, 368, 405, 406, DIG. 36, DIG. 40
See application file for complete search history.

(56) References Cited

U.S. PATENT DOCUMENTS

| | | | | |
|---|---|---|---|---|
| 3,345,710 | A * | 10/1967 | Bush | 24/573.11 |
| 3,675,499 | A * | 7/1972 | Marosy | 24/573.11 |
| 3,910,183 | A | 10/1975 | Noren et al. | |
| 4,803,922 | A * | 2/1989 | Dennesen | 101/41 |
| 5,095,594 | A * | 3/1992 | Marosy | 24/573.11 |
| 5,383,398 | A | 1/1995 | Binnen | |
| 6,715,416 | B1 | 4/2004 | Woloszyk | |
| 2007/0144365 | A1 | 6/2007 | Pulvino et al. | |

FOREIGN PATENT DOCUMENTS

| | | |
|---|---|---|
| GB | 748412 A | 5/1956 |
| WO | 8301599 | 5/1983 |

OTHER PUBLICATIONS

International Search Report for PCT/2009/039732 dated Aug. 3, 2009.

* cited by examiner

*Primary Examiner* — Ren Yan
(74) *Attorney, Agent, or Firm* — Levenfeld Pearlstein, LLC

(57) ABSTRACT

An auto alignment pad printer for transferring print to an associated object includes a frame, a fixture for supporting the associated object and a cliché operably mounted to the frame. The cliché includes at least one etched region and is adapted to receive ink in the etched region. An ink cup is configured to deposit ink into the etched region. A pad applicator includes a pad support having at least one pad thereon. The pad is adapted to move into and out of contact with the etched region to receive ink from the etched region and to contact an object to transfer the received ink to the object. A pad applicator alignment assembly includes a first set of cooperating projections and receivers mounted to the pad applicator and to the cliché and/or the frame near to the cliché, and a second set of cooperating projections and receivers mounted to the pad applicator and to the fixture for supporting the object. The first set of cooperating projections and receivers are configured to position the pad for precise movement into contact with the cliché to receive ink from the cliché. The second set of cooperating projections and receivers are configured to position the pad for precise movement into contact with the object to transfer the received ink to the associated object.

5 Claims, 2 Drawing Sheets

AUTO ALIGNING PAD PRINTER

BACKGROUND OF THE INVENTION

The present invention relates to pad printers. More particularly, the present invention relates to a pad printer having a precise print locating system for use in single or multiple station printing systems.

Pad printing systems are used to apply high quality print, e.g. indicia. Pad printing systems use a deformable pad which receives ink, transferred as an image, from a cliché plate. The cliché has an etching or engraving of the indicia formed therein. The image is transferred from the pad to the item onto which the indicia is applied. Typically, the pad moves in a reciprocating motion to contact the cliché plate and then move away from the cliché plate to an indicia application position.

In typical pad printers that use a flat cliché plate, the cliché plate has the image to be printed etched into the plate. Ink is applied to (and excess wiped from) the cliché by an ink cup. The ink cup and cliché move relative to one another to apply ink to the cliché. After the ink cup and cliché move away from one another, the pad is brought into contact with the inked cliché to pick up the ink (ink is transferred to the pad). The pad is then brought into contact with the item to transfer the print onto the item.

In current pad printing systems, the inked cliché plate is precision located on the printing machine and the pad is moved precisely to the printing position. The image is transferred (or deposited) onto a precision located substrate. This system is also used in a multi-color applications in which the substrate may then be transferred, and precision located at the next color station for the same process.

In order to achieve the desired print accuracy and quality, the printer must be manufactured with accurate cliché locating characteristics, the cliché must be manufactured with an accurately located etched image, the printer must be manufactured with precise and accurate pad location on the inking stroke and on the printing stroke and the substrate conveyance and fixturing system must be manufactured with precise and accurate part location at each printing station.

While this system design has been widely accepted in pad printing over the years, it has been found to have limitations. For example, achieving the desired precision in pad and substrate motion or fixturing tend to increase the cost to design, manufacture and maintain the system. At the same time, the very features that enable such precision are items that are subject to wear and that must be regularly serviced, if the original precision level is to be maintained.

Accordingly, there is a need for a pad printing system that provides greater accuracy in the pad printing process. Desirably, such a system provides this increased accuracy, without the need for high maintenance equipment and components.

SUMMARY OF THE INVENTION

An auto alignment pad printer for transferring print to an associated object includes a frame, a cliché operably mounted to the frame, the cliché including at least one etched region and adapted to receive ink thereon in the etched region and an ink cup configured to deposit ink into the at least one etched region.

The printer includes a fixture for supporting the associated object and a pad applicator for transferring the ink to the object. The pad applicator includes a pad support having at least one pad on the support. The pad is adapted to move into and out of contact with the etched region to receive ink from the etched region and configured to contact an associated object to transfer the received ink to the object.

A pad applicator alignment assembly includes a first set of cooperating projections and receivers mounted to the pad applicator and to the cliché and/or the frame near to the cliché, and a second set of cooperating projections and receivers mounted to the pad applicator and to the fixture for supporting the object.

The first set of cooperating projections and receivers is configured to position the pad for precise movement into contact with the cliché to receive ink from the cliché. The second set of cooperating projections and receivers is configured to position the pad for precise movement into contact with the object to transfer the received ink to the object.

These and other features and advantages of the present invention will be readily apparent from the following detailed description, in conjunction with the claims.

BRIEF DESCRIPTION OF THE DRAWINGS

The benefits and advantages of the present invention will become more readily apparent to those of ordinary skill in the relevant art after reviewing the following detailed description and accompanying drawings, wherein.

DETAILED DESCRIPTION OF THE INVENTION

Figure 1:
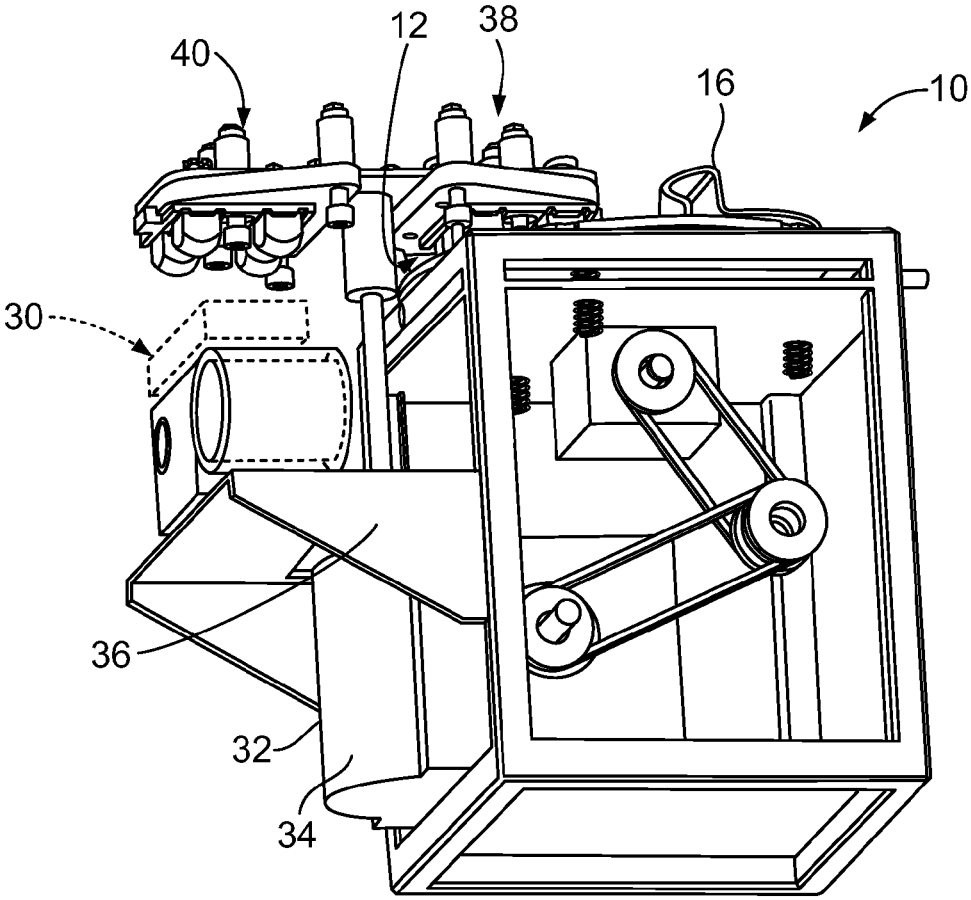
FIG. 1 is a bottom perspective illustration of an embodiment of an auto aligning pad printer assembly embodying the principles of the present invention, the aligning assembly being shown on a rotating cliché pad printer.

While the present invention is susceptible of embodiment in various forms, there is shown in the drawings and will hereinafter be described a presently preferred embodiment with the understanding that the present disclosure is to be considered an exemplification of the invention and is not intended to limit the invention to the specific embodiment illustrated.

It should be understood that the title of this section of this specification, namely, "Detailed Description Of The Invention", relates to a requirement of the United States Patent Office, and does not imply, nor should be inferred to limit the subject matter disclosed herein.

Referring now to the figures and briefly to FIG. 1 there is shown an exemplary pad printing system 10 having an auto aligning pad printing assembly 12 embodying the principles of the present invention. The illustrated printing system is of a rotating cliché type in which the cliché plate 14 and ink cup 16 rotate relative to one another. In the illustrated printer, the cliché plate is stationary and the ink cup rotates about the plate to deposit ink in the various etched regions 18*a-d* (see FIG. 4) in the plate.

An ink supply system (not shown) typically includes the ink cup that, in the rotating design moves (rotates) relative to the cliché plate to deposit ink in each of the etched regions and to remove or wipe excess ink from the etched region and assure even deposit of ink in the etchings. As will be appreciated by those skilled in the art, the ink supply system can be gravity fed or pump fed with or without a recovery system.

Figure 4:
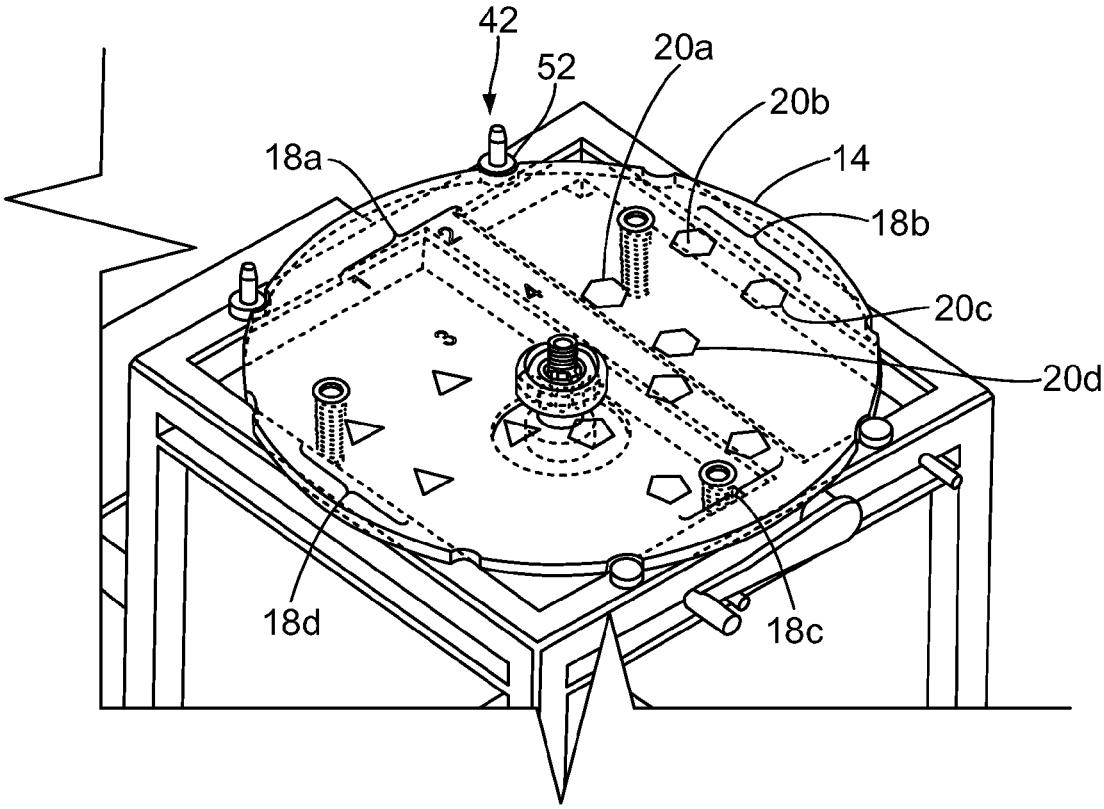
FIG. 4 is a perspective view of an exemplary circular cliché plate that can be used with the present auto aligning assembly.

The illustrated circular cliché plate includes multiple locations 18*a-d* having etched regions therein. Referring briefly to FIG. 4, the plate can include more than one set of etchings, such as the four sets of etchings illustrated. Within each region 18*a-d* there can be multiple etchings 20*a-d* that represent the desired printing to be transferred. It will be appreciated that multiple etchings or a single etching can be present in each region.

Figure 2:
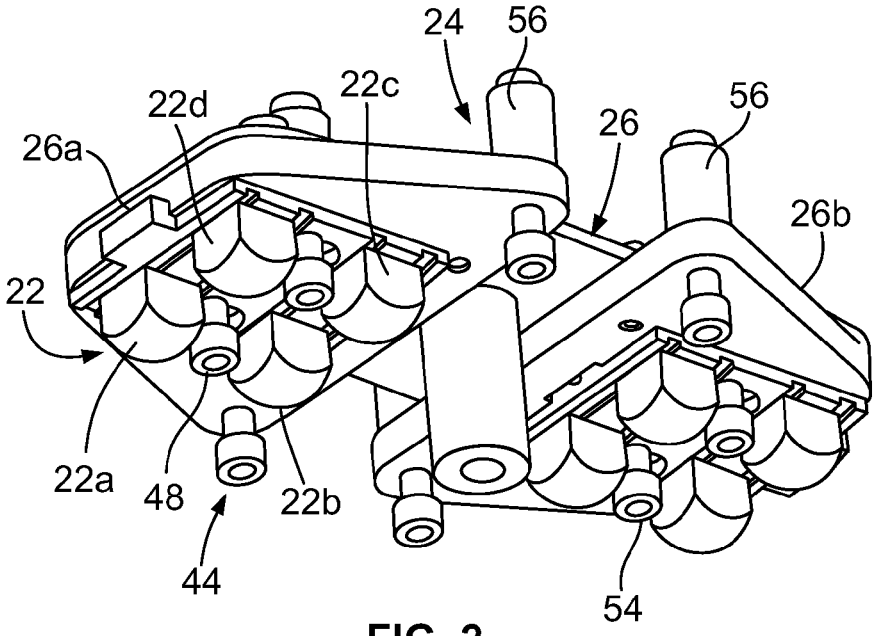
FIG. 2 is bottom perspective illustration of the pad support of FIG. 1.

As seen in FIGS. 1 and 2, one or more pads 22 are mounted to a pad assembly 24. The pad assembly moves the pad or pads into contact with the inked cliché plate and then into contact with the item or items I to be printed.

In the illustrated embodiment, four pads 22*a-d* are present on each side 26*a,b* of a support member 26. The support member is allowed to "float" to, as is described below, permit alignment of the support/pads with the cliché and with the item to be printed. Each of the four pads is configured to contact one of the etched regions and then move into position and contact one of the items to be printed. In the illustrated printer and fixture, balls are supported within the fixture 28 (which is positioned generally at about 30 in FIG. 1), and the pads are brought into contact with the balls I to transfer print to the balls.

A pad drive assembly 32 includes a reciprocating drive 36 and a rotational drive 34. The reciprocating drive moves the pads vertically, at a first radial position (indicated generally at 38) into and out of contact with the cliché plate (to transfer ink in the form of an image onto the pad) and at a second radial position (indicated generally at 40), moves the same pads into and out of contact with the items to be printed to transfer the image from the pads to the items.

It is the same vertical reciprocating motion, e.g., a single reciprocating motion, that effects both transfer from the cliché to the pads and transfer from the pads to the items. It will be appreciated that transfer from the cliché to the pads for the first set of pads (at the first radial position) occurs at the same time that transfer of the image from the pads to the items occurs with the second set of pads (at the second radial position).

The pad rotational drive rotates the pads from the first radial position to the second radial position and from the second radial position to the first radial position. In other words, the rotational drive rotates the pads (between radial positions) from over the cliché plate to over the items to be printed.

The printing pad rotational drive uses a servo motor to provide precise control of the movement of the pads. The reciprocating movement of the pad drive can be by cylinder, motor or other drive. Likewise, the rotational drive can also be other suitable type drives, which other drives will be recognized and appreciated by those skilled in the art.

Figure 3:
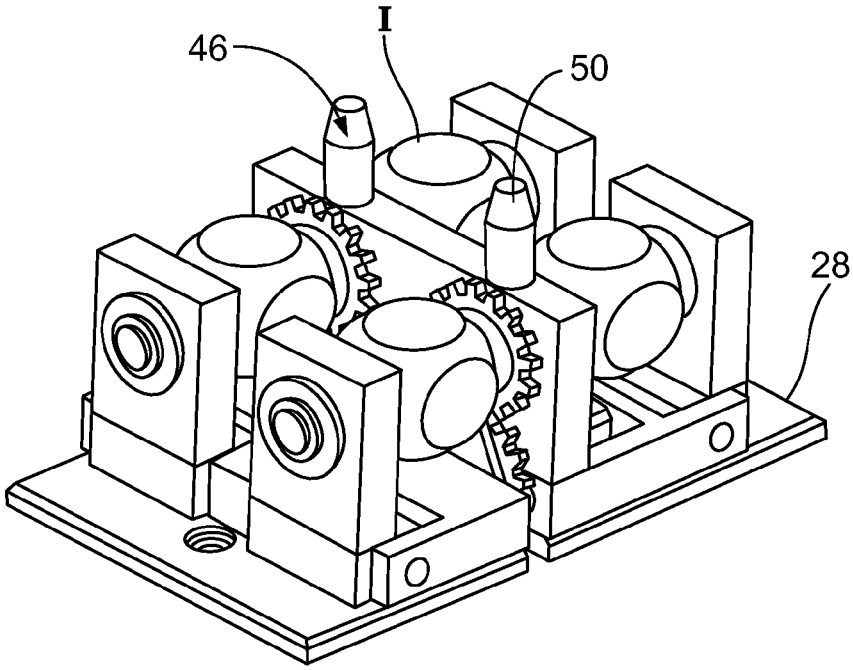
FIG. 3 is top perspective illustration of the substrate (item) fixture for supporting the items to which print is transferred, the fixture shown removed from the printer for ease of illustration.

In order to precisely align or position the pads in contact with the etched regions of the cliché (to precisely position the pads relative to the etched images) when transferring the images to the pads, the pad support and the cliché plate (or the printer frame in conjunction with the cliché plate), include cooperating aligning elements. A first set of elements 42, 44 is mounted to the cliché plate or the frame (42), adjacent to the cliché plate and to the pad support member (44). A second set of elements 46, 48 is mounted to the fixture (46) and to the pad support member (48). In a present embodiment, the cooperating elements are upstanding rigid pins 42, 46 and pin receivers 44, 48. The head 50 of each pin can be tapered. The pins are mounted to the frame immediately adjacent to the cliché plate. A rigid alignment element 52 can be positioned at the base of the pins and resides within notches formed in the periphery of the plate. This helps maintain alignment of plate and positioning of the plate on the frame. Pins 46 are also located on the fixture (see FIG. 3). In a present embodiment, the pins are located between the items (balls).

The pin receivers 44, 48 are biased receivers that are formed as sleeve-like plungers. The central portion 54 of each plunger is open and configured to receive a respective pin. The taper of the pins is provided to help center the pins as they are received in their respective sleeves.

The plungers are biased or spring loaded. In this manner, for example in the inking mode, as the pad support is moved downward to contact the pads with the cliché plate, the pins are received in the plunger opening which aligns the pad support member and the cliché plate. Continued downward movement moves the pads into contact with the cliché plate. At the same time, the pin remains received in the plunger opening and the plunger retracts (against a spring—not shown—bias) into a plunger housing 56. This retains the alignment of the pads and the cliché etched images. It will be appreciated that because the support member 26 is mounted to the drive permit "float", alignment of the of the printing pads to the cliché image occurs by virtue of the insertion of the pins into the receivers.

Likewise, in transferring the ink to the balls, as the pads move down to contact the balls, the pins engage the plungers to precisely align the pads with the fixture and thus with the balls. Continued movement of the pads compresses the plunger stem into the housing, but retains the plungers on the pins to assure alignment. In the illustrated embodiment, the fixture/ball alignment plungers are located between the balls to further enhance alignment of the pads and balls. It will however be appreciated that the pins and plungers can be located anywhere practicable on the support and the fixture to assure proper alignment. It will be appreciated that although two sets of pins and receivers are shown and described, the present alignment system can be configured and functions well with one, two or more sets of pins and receivers.

In use, similar to current practice, the image to be printed is etched into the cliché surface at a precise location and the cliché is precisely located on the printing machine. The printing pad holder self aligns with the printing cliché and image during the down stroke, prior to picking up the image on the inking stroke, and again self aligns with the substrate during the down stroke, prior to depositing the image on the printing stroke. These alignment features at all three positions—cliché plate, printing pad support and item (ball) fixture—are manufactured to tight tolerances.

When used in multi-color printing systems, an image is separated into multiple single color images which are printed into the same area. Typically, the item (in the present example, the ball) fixture is transported from one color station to another and at each station a color is applied to the item. These images must be aligned accurately to each other to achieve the desired final decoration.

It will be appreciated that because the present system provides accurate and precise control of the location of the application and printing, it provides significant advantages in accurately locating the fixture (and ths the item) relative to the multiple pads, for such multi-color printing systems.

It will also be appreciated that in the present system, the high cost, high precision moving components have been eliminated (pad motion devices, substrate transfer/fixture systems), in favor of passive, stationary (relative to their assembly) alignment features. Item (ball) transfer can now be achieved with standard tolerance conveyor systems, rather than custom designed conveyor systems with cammed, or pinned location at each station. This same conveyor can be a less precise belt or chain style, rather than a high precision linked pallet design. The pad motion axis can now also be designed with more commonly available components, with no additional precision guidance required.

The accuracy of the pad to image, and pad to item is achieved with passive components, and limited to the specific area that they are required. The present self aligning pad printing design enables as high, or higher precision print location, over a longer period of time, for a lower cost, when compared to known pad printing technology.

It will be appreciated that although four "sets" of etchings are shown (in FIG. 4) and described relative to the present system any number of sets of etchings (and etchings within each set) can be used, as practical, as can more than one pad drive assembly and station.

All patents referred to herein, are incorporated herein by reference, whether or not specifically done so within the text of this disclosure.

In the disclosure, the words "a" or "an" are to be taken to include both the singular and the plural. Conversely, any reference to plural items shall, where appropriate, include the singular.

From the foregoing it will be observed that numerous modification and variations can be effectuated without departing from the true spirit and scope of the novel concepts of the present invention. It is to be understood that no limitation with respect to the specific embodiments illustrated is intended or should be inferred. The disclosure is intended to cover by the appended claims all such modifications as fall within the scope of the claims.

What is claimed is:

1. An auto alignment pad printer for transferring print to an associated object, comprising:

a frame;

a fixture for supporting the associated object;

a cliché operably mounted to the frame, the cliché including at least one etched region and adapted to receive ink thereon;

an ink cup configured to deposit ink into the at least one etched region;

a pad applicator including a pad support having at least two pads thereon, the pad support configured to reciprocate to move a first pad into and out of contact with the at least one etched region at a first radial position to receive ink from the etched region and to simultaneously move a second pad into and out of contact with an associated object at a second radial position to transfer the received ink to the associated object, the pad support movable about an axis between the first and second positions; and a pad applicator alignment assembly including a first set of cooperating projections and receivers mounted to the pad applicator and to the cliché, each receiver including a spring which biases the receiver, each receiver being configured to accept a respective one of the first set of cooperating projections, and a second set of cooperating projections and receivers mounted to the pad applicator and to the fixture for supporting the associated object, each receiver including a spring which biases the receiver, each receiver being configured to accept a respective one of the second set of cooperating projections, wherein the first set of cooperating projections and receivers is configured to position the first pad for precise movement into contact with the cliché to receive ink from the cliché, and, simultaneously, the second set of cooperating projections and receivers is configured to position the second pad for precise movement into contact with the associated object to transfer the received ink to the associated object.

2. The auto alignment pad printer in accordance with claim 1 wherein the receivers are sleeve-like plungers having an open central region for receiving the projections.

3. The auto alignment pad printer in accordance with claim 1 wherein the projections are pins having tapered ends.

4. The auto alignment pad printer in accordance with claim 1 wherein the cooperating projections are located on the cliché and on the fixture for supporting the associated object, and wherein the receivers are mounted to the pad applicator.

5. The auto alignment pad printer in accordance with claim 1, including a pad rotational device, the pad rotational device rotating the pad support from the first radial position to the second radial position.

* * * * *